US008613373B2

(12) United States Patent
Holtby et al.

(10) Patent No.: US 8,613,373 B2
(45) Date of Patent: Dec. 24, 2013

(54) TUBING TRAY AND METHOD FOR USING SAME FOR COLLECTING FLUIDS DRAINING FROM DRILL PIPE

(76) Inventors: Quinn A. J. Holtby, Edmonton (CA); Dallas Laird Greenwood, Edmonton (CA)

( * ) Notice: Subject to any disclaimer, the term of this patent is extended or adjusted under 35 U.S.C. 154(b) by 0 days.

(21) Appl. No.: 13/565,549

(22) Filed: Aug. 2, 2012

(65) Prior Publication Data

US 2013/0306153 A1 Nov. 21, 2013

Related U.S. Application Data

(60) Provisional application No. 61/649,138, filed on May 18, 2012.

(51) Int. Cl.
*B65D 1/34* (2006.01)

(52) U.S. Cl.
USPC ..... 220/571; 175/424

(58) Field of Classification Search
USPC ..... 137/312; 220/571; 175/207, 315, 424
See application file for complete search history.

(56) References Cited

U.S. PATENT DOCUMENTS

| | | | | | |
|---|---|---|---|---|---|
| 4,475,604 | A * | 10/1984 | Albertson et al. | ..... | 175/85 |
| 5,823,382 | A * | 10/1998 | Van Giezen et al. | ..... | 220/571 |
| 6,116,266 | A * | 9/2000 | Dickison et al. | ..... | 137/312 |
| 7,637,387 | B1 * | 12/2009 | Cantolino | ..... | 220/571 |
| 8,479,945 | B1 * | 7/2013 | Simmons | ..... | 220/571 |

* cited by examiner

*Primary Examiner* — John Rivell
*Assistant Examiner* — Reinaldo Sanchez-Medina

(57) ABSTRACT

A tubing tray is provided for use with a pipe mat tray for receiving, organizing and storing drill pipe tripped out of a drill string on a drilling rig, the tubing tray having a planar bottom member, an orthogonal sidewall extending upwardly from the perimeter of the bottom member to form a basin for receiving the pipe mat, a chamfered sidewall extending upwardly and outwardly from the sidewall to provide clearance for a tool joint on a drill pipe placed on the pipe mat, and a handle extending around a top edge of the chamfered sidewall, the handle having a downwardly extending lip forming a finder hold thereunder. The tray can further include spikes extending downwardly from a lower surface of the bottom member, and a slot disposed through opposing lips of the handle allowing two or more tubing trays to be fastened together in a side by side configuration.

16 Claims, 8 Drawing Sheets

TUBING TRAY AND METHOD FOR USING SAME FOR COLLECTING FLUIDS DRAINING FROM DRILL PIPE

CROSS REFERENCE TO RELATED APPLICATIONS

This application claims priority of U.S. Provisional Patent Application Ser. No. 61/649,138, entitled "Tubing Tray and Method for Using Same for Collecting Fluids Draining from Drill Pipe", filed May 18, 2012, and hereby incorporates the same provisional application by reference herein in its entirety.

TECHNICAL FIELD

The present disclosure is related to the field of tubing trays, in particular, tubing trays for use with pipe mats used on drilling rigs for organizing and placing drill pipe on when being tripped in or out of a drill string, and methods for collecting fluids draining from the drill pipe.

BACKGROUND

There is a need for a tubing tray to be used, in conjunction with a pipe mat, to receive, organize and store drill pipe on when being tripped in or out of a drill string, and to provide means and a method for receiving fluids draining from the drill pipe and channeling the fluids away from the drill pipe for storage, recycling or disposal after the drill pipe has been removed from the tubing tray.

SUMMARY

A tubing tray is provided for use with a pipe mat for receiving, organizing and storing drill pipe tripped out of a drill string on a drilling rig. In some embodiments, the tubing tray can comprise a planar bottom member, an orthogonal sidewall extending upwardly from the perimeter of the bottom member to form a basin for receiving the pipe mat, a chamfered sidewall extending upwardly and outwardly from the sidewall to provide clearance for a tool joint on a drill pipe placed on the pipe mat, and a handle extending around a top edge of the chamfered sidewall, the handle having a downwardly extending lip to form a finder hold thereunder. The tray can further comprise spikes extending downwardly from a lower surface of the bottom member, and can further comprise a slot disposed through opposing lips of the handle to allow two or more tubing trays to be fastened together in a side by side configuration.

In some embodiments, a method is provided for collecting fluids draining from drill pipe tripped out of a drill string on a drilling wherein a tubing tray, with a pipe mat placed therein, to receive the drill pipe. An end of the drill pipe can be placed onto the pipe mat disposed in the tubing tray to hold the drill pipe in position. Fluids in the drill pipe can drain through the openings disposed through the pipe mat to collect in the tubing tray.

Broadly stated, in some embodiments, a tubing tray is provided for use with a pipe mat for receiving, organizing and storing drill pipe tripped out of a drill string on a drilling rig, the tubing tray comprising: a substantially planar bottom member further comprising an upper surface, a lower surface and a perimeter edge extending around a perimeter of the bottom member; a sidewall extending upwardly from the perimeter edge along the perimeter, the sidewall substantially orthogonal to the bottom member thereby defining a basin therein, the basin configured to receive a pipe mat placed therein, the sidewall further comprising an upper edge thereon; a chamfered sidewall extending upwardly and outwardly from the upper edge of the sidewall to define a seam therebetween, the chamfered sidewall extending along the seam, the chamfered sidewall further comprising a top edge thereon, wherein the combination of the sidewall and the chamfered sidewall are configured to provide clearance for a tool joint disposed on an end of the drill pipe placed on the pipe mat; and a handle extending along the top edge of the chamfered sidewall, the handle further comprising a downwardly extending lip disposed therealong thereby forming a finger hold disposed thereunder.

Broadly stated, in some embodiments, each of the pipe nubs can comprise a triangular profile or cross-sectional shape.

Broadly stated, in some embodiments, the bottom member can comprise a rectangular shape.

Broadly stated, in some embodiments, the tubing tray can further comprise a slot extending through the lip, the slot configured to receive a fastener passed therethrough, the fastener configured to pass through the slot of a second tubing tray wherein the tubing tray and the second tubing tray can be fastened together with the fastener.

Broadly stated, in some embodiments, the tubing tray can further comprise a second slot extending through the lip on an opposing side of the tubing tray wherein a plurality of tubing trays can be fastened together in a side by side configuration.

Broadly stated, in some embodiments, the tubing tray can further comprise a plurality of spikes disposed on the lower surface of the bottom member extending downwardly therefrom.

Broadly stated, in some embodiments, at least one spike can comprise a rectangular shape or a trapezoidal cross-sectional shape that tapers or narrows in width as the at least one spike extends from the lower surface.

Broadly stated, in some embodiments, the plurality of spikes can be configured into at least one L-shaped configuration disposed near a corner of the lower surface.

Broadly stated, in some embodiments, the plurality of spikes can be configured into an X-shaped configuration disposed near a center of the lower surface.

Broadly stated, in some embodiments, a method is provided for collecting fluids draining from drill pipe tripped out of a drill string on a drilling rig, the method comprising the steps of: providing a tubing tray for use with a pipe mat for receiving, organizing and storing drill pipe thereon, the tubing tray comprising: a substantially planar bottom member further comprising an upper surface, a lower surface and a perimeter edge extending around a perimeter of the bottom member, a sidewall extending upwardly from the perimeter edge along the perimeter, the sidewall substantially orthogonal to the bottom member thereby defining a basin therein, the basin configured to receive a pipe mat placed therein, the sidewall further comprising an upper edge thereon, a chamfered sidewall extending upwardly and outwardly from the upper edge of the sidewall to define a seam therebetween, the chamfered sidewall extending along the seam, the chamfered sidewall further comprising a top edge thereon, wherein the combination of the sidewall and the chamfered sidewall are configured to provide clearance for a tool joint disposed on an end of the drill pipe placed on the pipe mat, and a handle extending along the top edge of the chamfered sidewall, the handle further comprising a downwardly extending lip disposed therealong thereby forming a finger hold disposed thereunder; placing the pipe mat into the tubing tray; and placing an end of a drill pipe tripped out of the drill string onto a pipe nub disposed on the pipe mat, wherein fluids disposed within the drill pipe can drain from the drill pipe through openings extending through the pipe mat and collect in the tubing tray.

DETAILED DESCRIPTION OF EMBODIMENTS

Figure 1:
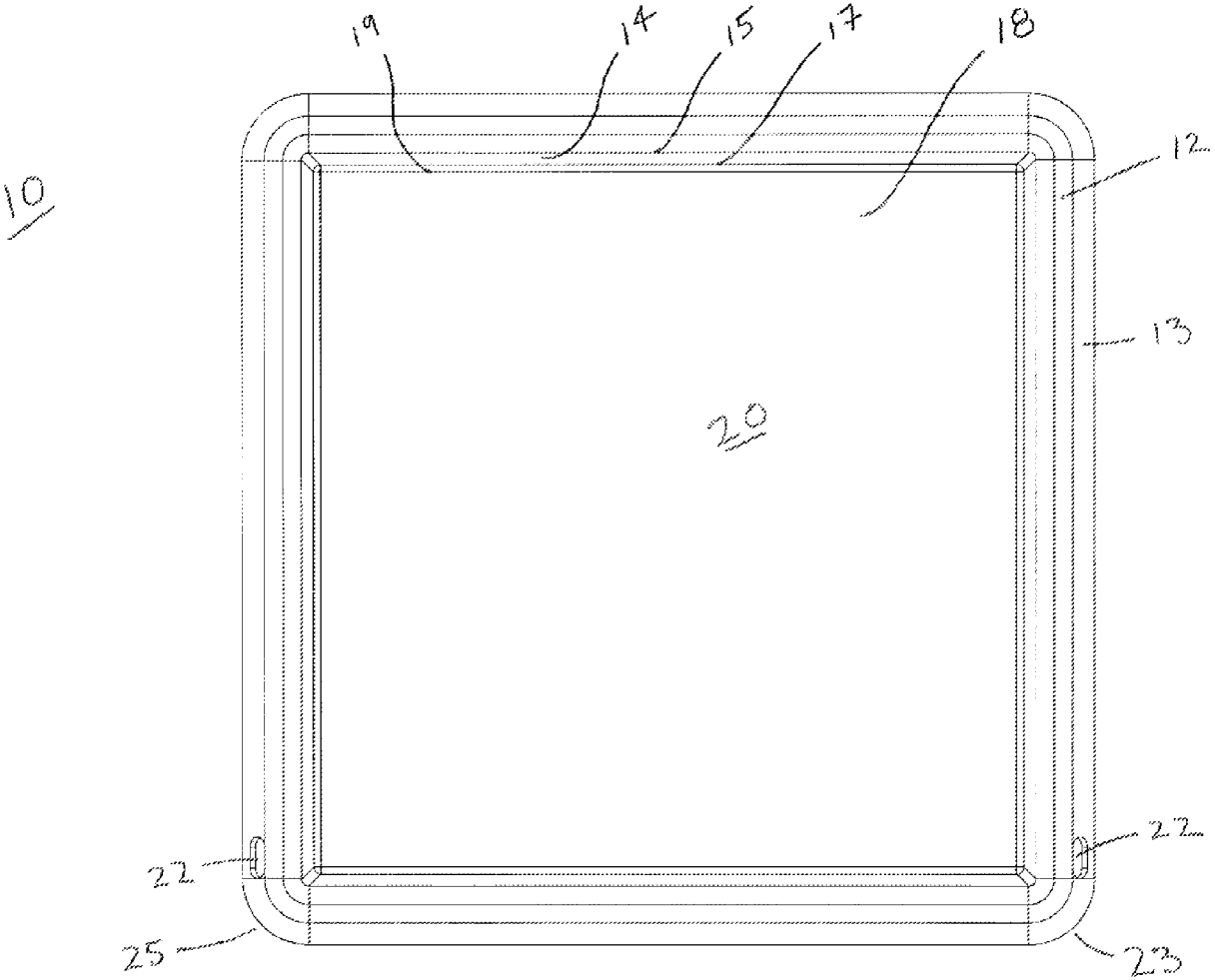
FIG. 1 is a top plan view depicting one embodiment of a tubing tray.
Figure 2:
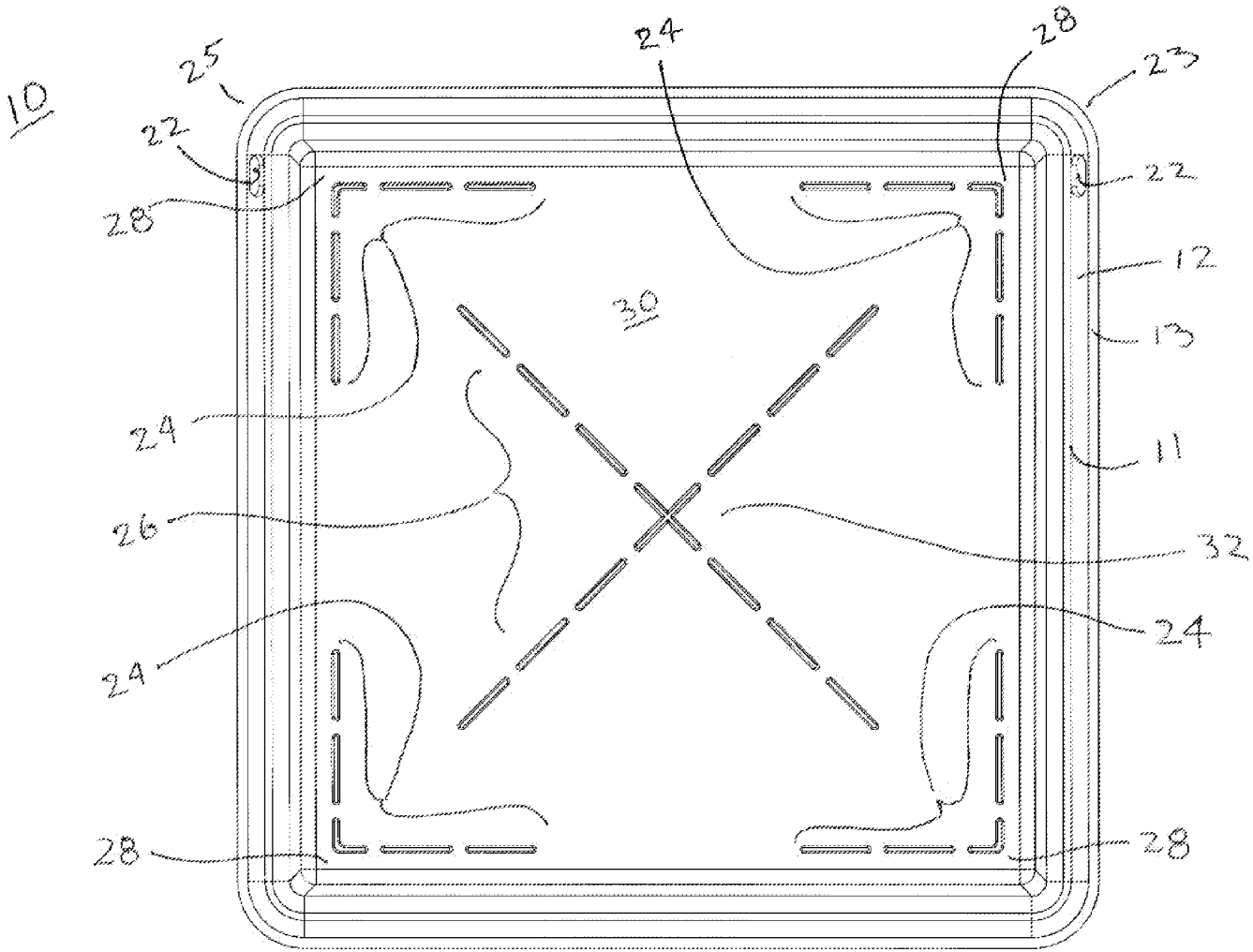
FIG. 2 is a bottom plan view depicting the tubing tray of FIG. 1.
Figure 3:
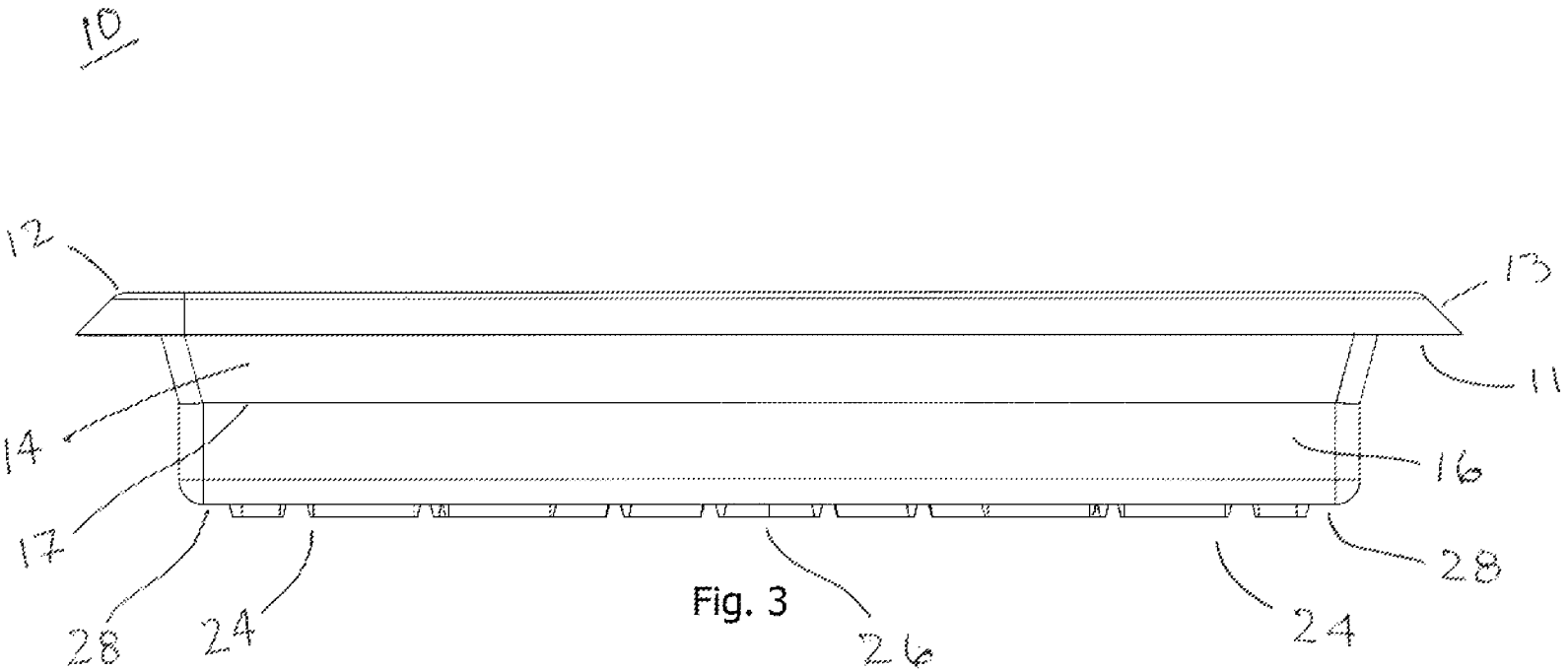
FIG. 3 is a front elevation view depicting the tubing tray of FIG. 1.
Figure 4:
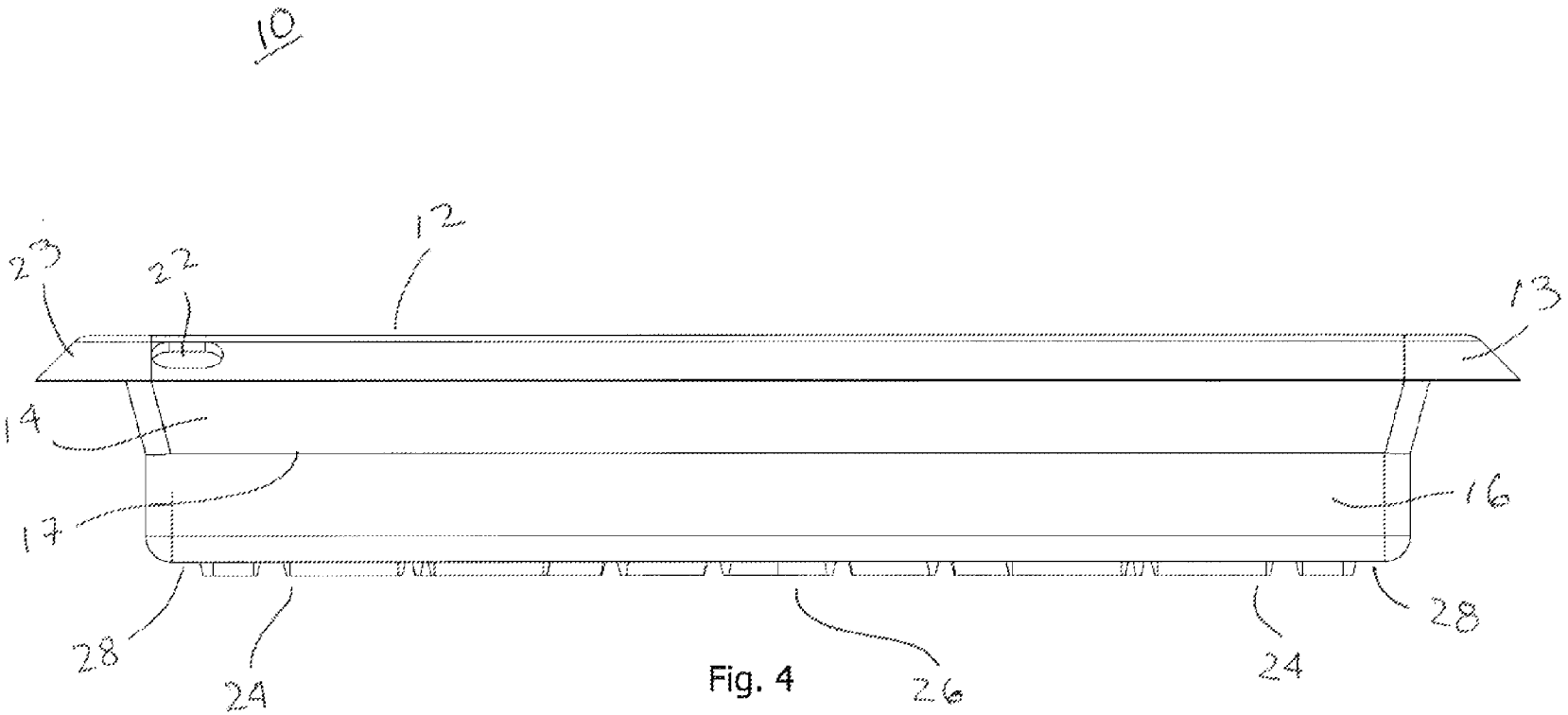
FIG. 4 is a side elevation view depicting the tubing tray of FIG. 1.
Figure 5:
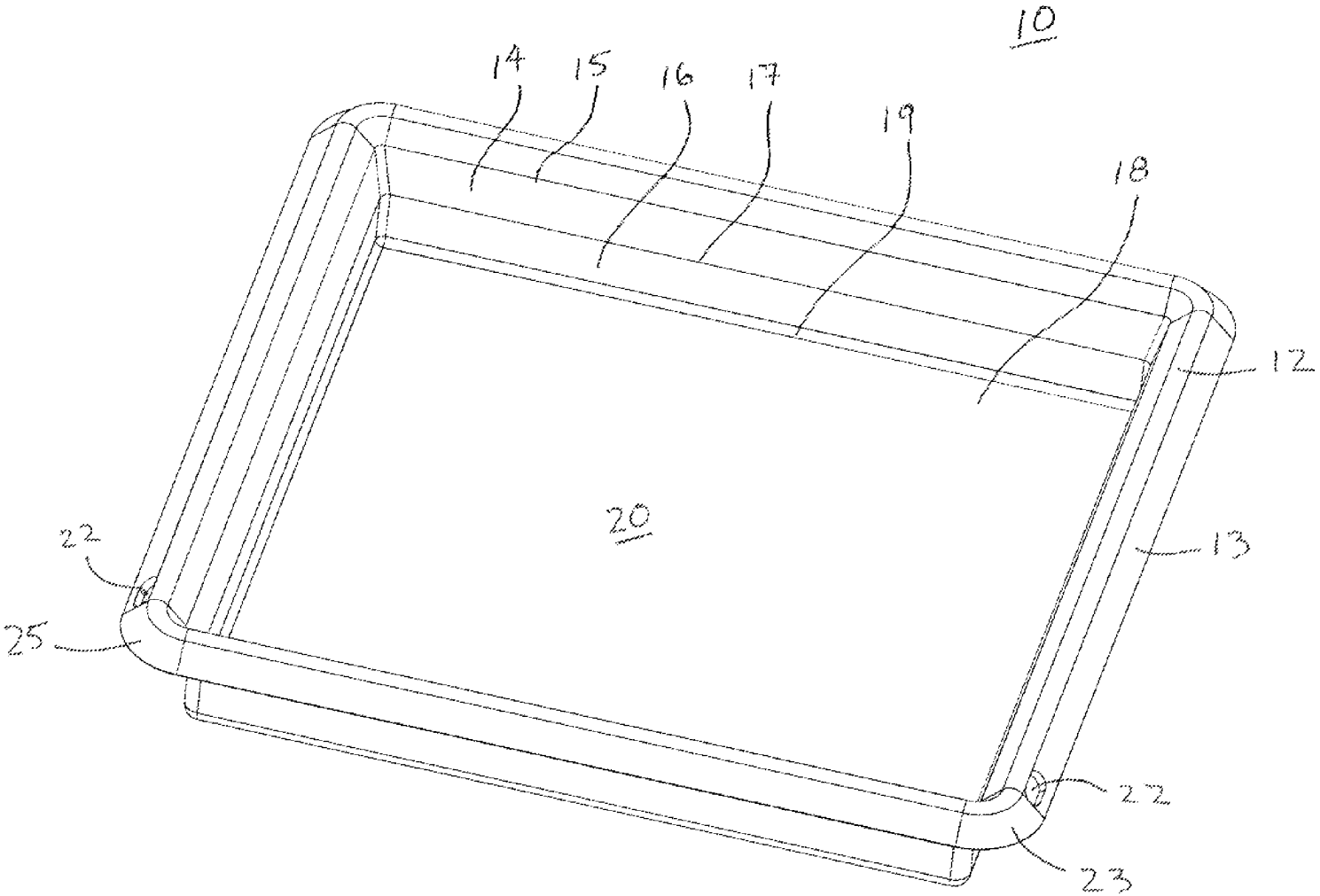
FIG. 5 is a top perspective view depicting the tubing tray of FIG. 1.
Figure 6:
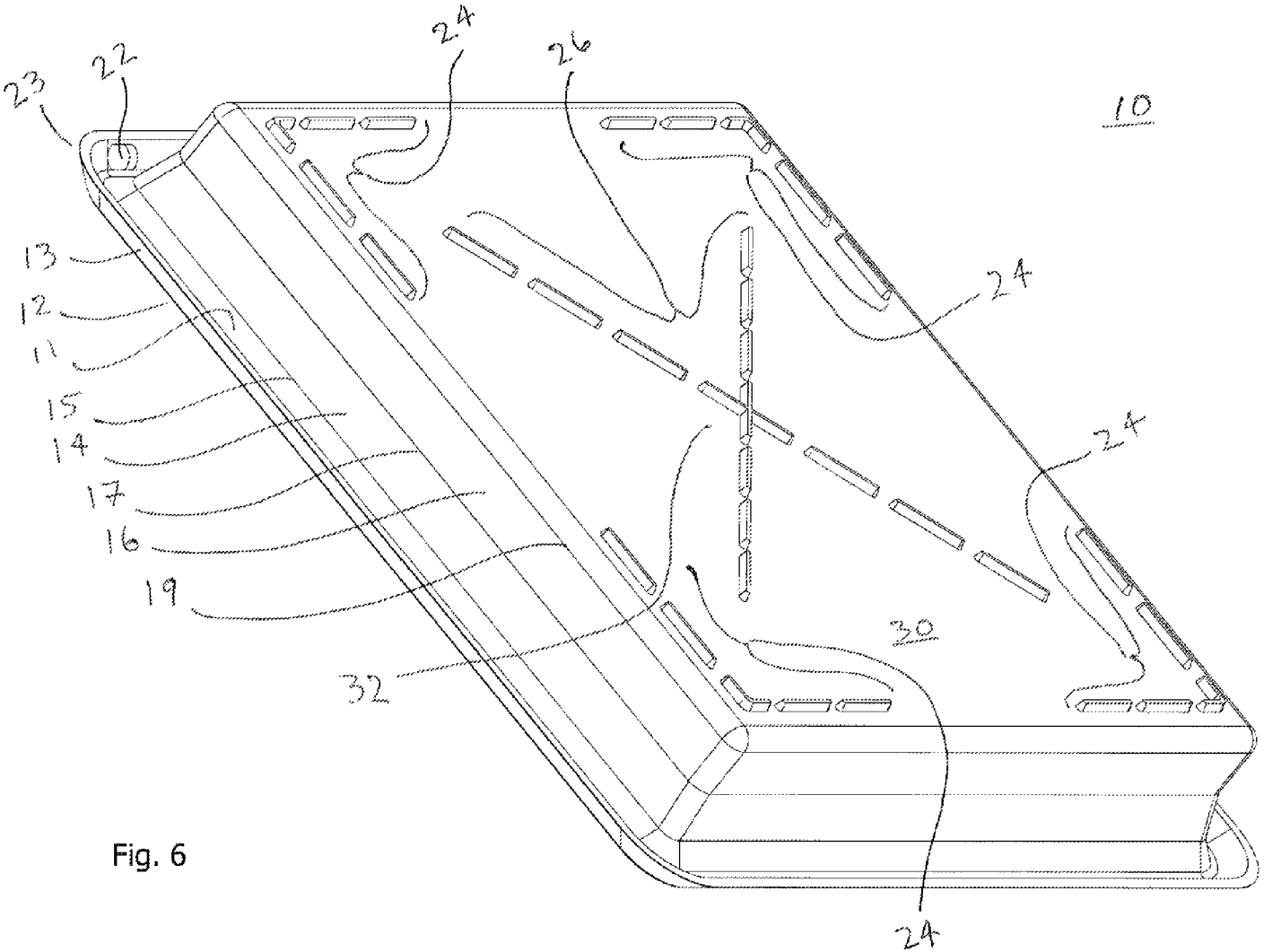
FIG. 6 is a bottom perspective view depicting the tubing tray of FIG. 1.

Referring to FIGS. 1 to 6, one embodiment of tubing tray 10 is shown. In some embodiments, tubing tray 10 can comprise substantially planar bottom member 20 further comprising sidewalls 16 extending upwardly from bottom member 20 along perimeter edge 19 of bottom member 20 to define basin 18 therein, wherein sidewalls 16 can be substantially orthogonal to bottom member 20. In some embodiments, tubing tray 10 can comprise chamfered sidewalls 14 extending upwardly and outwardly from seam 17 disposed between sidewalls 16 and chamfered sidewalls 14 wherein chamfered sidewalls 16 can taper inwardly and downwardly towards basin 18 from top edge 15 to seam 17. In some embodiments, bottom member 20 can be rectangular in configuration wherein tubing tray 10 can comprise four sidewalls 16 extending upwardly therefrom to form basin 18.

In some embodiments, tubing tray 10 can comprise handle 12 extending from top edge 15 of chamfered sidewalls 14. In some embodiments, handle 12 can comprise lip 13 that can extend outwardly and downwardly to form finger hold 11 disposed thereunder to provide means for grasping and lifting tubing tray 10. In some embodiments, handle 12 can extend all around the perimeter of tubing tray 10.

In some embodiments, tubing tray 10 can comprise one or more spikes 24 disposed near one or more of corners 28 extending downwardly from lower surface 30 of bottom member 20. In some embodiments, tubing tray 10 can comprise one or more spikes 26 disposed near center 32 of lower surface 30 extending downwardly therefrom. In some embodiments, providing spikes 24 or 26 disposed on lower surface 30 can provide means to keep tubing tray 10 from moving or slipping when placed on the ground, that is, on earth, sand, mud, snow, ice, gravel and the like. In some embodiments, spikes 24 or 26 can comprise one or more longitudinally shaped members that can further comprise a rectangular cross-sectional shape, or a trapezoidal cross-sectional shape that tapers or narrows in width as spikes 24 or 26 extend from lower surface 30, wherein such a cross-sectional shape can improve the ability of tubing tray 10 to contact and grip the ground to prevent it from moving or slipping. In some embodiments, spikes 24 can be configured into an L-shape configuration disposed near corner 28. In some embodiments, spikes 26 can be configured into an X-shaped configuration disposed near center 32.

In some embodiments, lip 13 can comprise one or more slots 22 disposed therethrough to provide means for joining two or more tubing trays 10 together in a row. In some embodiments, one slot 22 can be disposed through lip 13 near corner 23 and a second slot 22 disposed through lip 13 on an opposing side of tubing tray 10 near corner 25 that wherein the slots 22 can be substantially aligned. In so doing, two adjacent tubing trays 10 can be placed beside each other and fastened together by placing a tie-wrap, tie-wire, rope or strand through slots 22 of two adjacent tubing trays 10 to fasten them together, as obvious to those skilled in the art.

Figure 7:
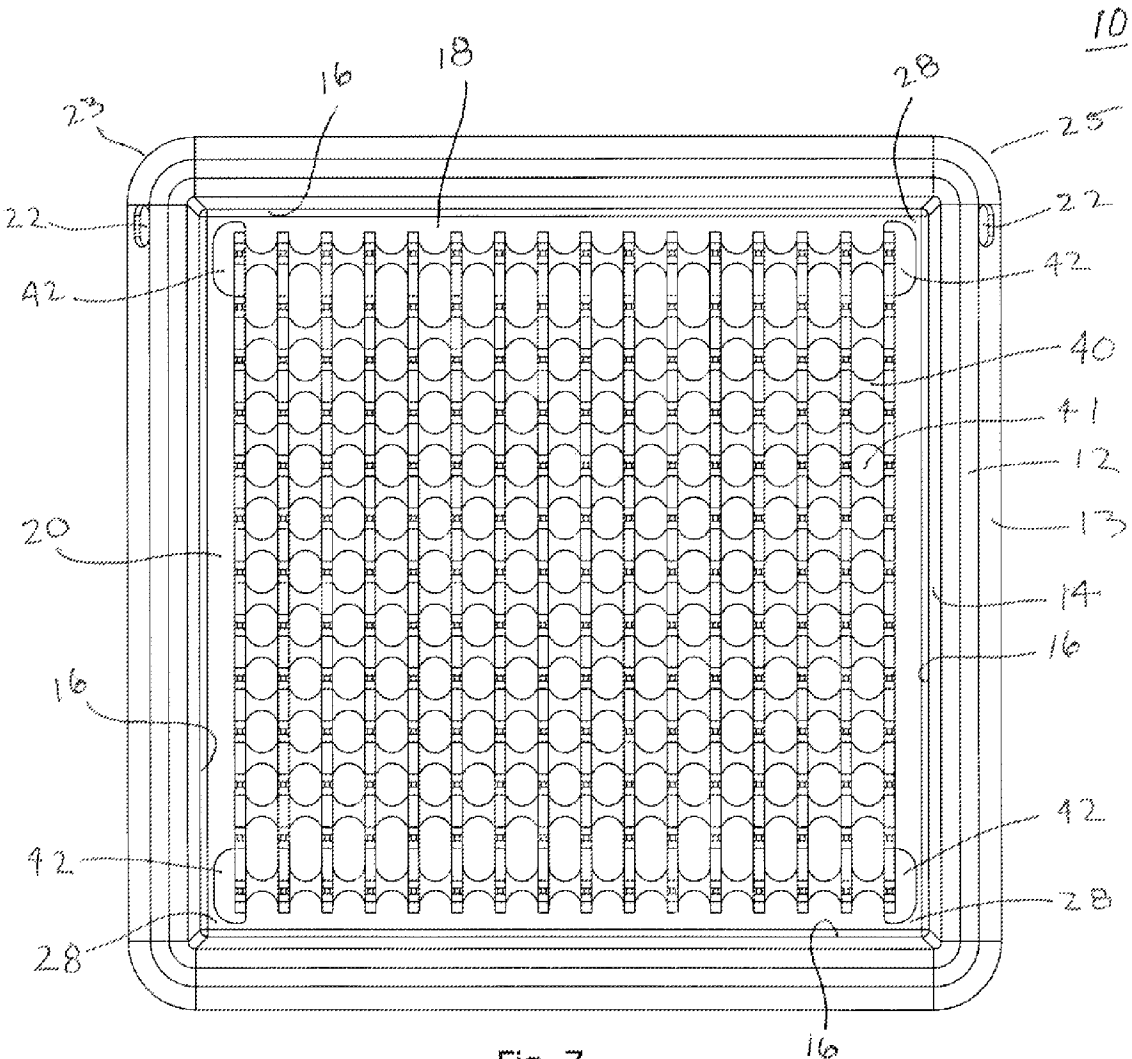
FIG. 7 is a top plan view depicting the tubing tray of FIG. 1 with a pipe mat disposed in the basin of the tubing tray.

Referring to FIG. 7, in some embodiments, tubing tray 10 can be used with pipe mat 40 that can be placed in basin 18 on top of bottom member 20. In some embodiments, pipe mat 40 can comprise the pipe mat disclosed and claimed in U.S. Provisional Patent Application No. 61/647,393 filed on May 15, 2012, which is incorporated by reference into this application in its entirety.

In some embodiments, bumpers 42 disposed on pipe mat 40 can be used to center pipe mat 40 in tubing tray 10 wherein bumpers 42 can contact sidewalls 16 disposed near corners 28. By providing bumpers 16 on pipe mat 40, bumpers 16 can prevent pipe mat 40 from sliding or shifting within basin 18 of tubing tray 10, as drill pipe is placed onto or removed from pipe mat 10, by contacting inner corners 30 of tubing tray 10 as a means to keep pipe mat 40 centered within tubing tray 10.

Figure 8:
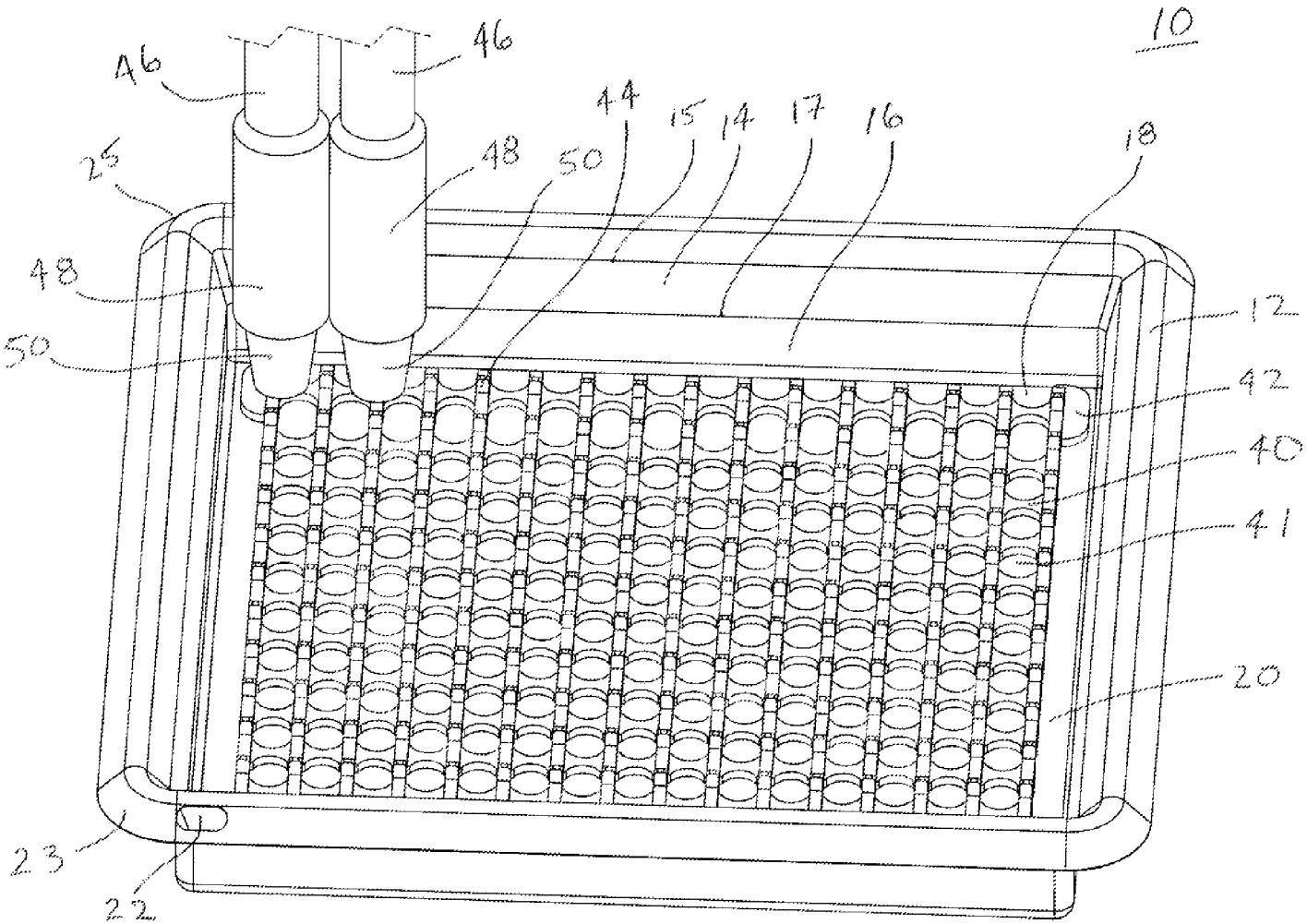
FIG. 8 is a perspective view depicting the tubing tray of FIG. 7 with drill pipe standing on the pipe mat disposed in the tubing tray.

Referring to FIG. 8, tubing tray 10 is shown with pipe mat 40 disposed in basin 18 with pieces of drill pipe 46 placed on pipe mat 40 wherein end 50 of each drill pipe 46 can be placed onto a pipe nub 44, which can hold drill pipe 46 in place and prevent it from moving or shifting once placed on pipe mat 40. As noted above and as shown in the figures, chamfered sidewalls 14 can extend upwardly and outwardly from seam 17 as means to guide drill pipe 46 towards pipe mat 40 and as a means to provide clearance for tool joint 48 disposed on drill pipe 46 near end 50.

When drill pipe 46 is tripped out of a drill string, any residual drilling fluid or produced substances in drill pipe 46 can drain therefrom and pass through openings 41 disposed through pipe mat 40 to collect in tubing tray 10 while holding drill pipe 46 above bottom member 20 of basin 18. In so doing, the drained fluids can be contained in tubing tray 10 for recycling or proper disposal when all of the pieces of drill pipe 46 have been removed therefrom.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. A tubing tray for use with a pipe mat for receiving, organizing and storing drill pipe tripped out of a drill string on a drilling rig, the tubing tray comprising:

a) a substantially planar bottom member further comprising an upper surface, a lower surface and a perimeter edge extending around a perimeter of the bottom member;

b) a sidewall extending upwardly from the perimeter edge along the perimeter, the sidewall substantially orthogonal to the bottom member thereby defining a basin therein, the basin configured to receive a pipe mat placed therein, the sidewall further comprising an upper edge thereon;

c) a chamfered sidewall extending upwardly and outwardly from the upper edge of the sidewall to define a seam therebetween, the chamfered sidewall extending along the seam, the chamfered sidewall further comprising a top edge thereon, wherein the combination of the sidewall and the chamfered sidewall are configured to provide clearance for a tool joint disposed on an end of the drill pipe placed on the pipe mat; and d) a handle extending along the top edge of the chamfered sidewall, the handle further comprising a downwardly extending lip disposed therealong thereby forming a finger hold disposed thereunder.

2. The tubing tray as set forth in claim 1, wherein the bottom member comprises a rectangular shape.

3. The tubing tray as set forth in claim 1, further comprising a slot extending through the lip, the slot configured to receive a fastener passed therethrough, the fastener configured to pass through the slot of a second tubing tray wherein the tubing tray and the second tubing tray can be fastened together with the fastener.

4. The tubing tray as set forth in claim 3, further comprising a second slot extending through the lip on an opposing side of the tubing tray wherein a plurality of tubing trays can be fastened together in a side by side configuration.

5. The tubing tray as set forth in claim 1, further comprising a plurality of spikes disposed on the lower surface of the bottom member extending downwardly therefrom.

6. The tubing tray as set forth in claim 5, wherein at least one spike comprises a rectangular shape or a trapezoidal cross-sectional shape that tapers or narrows in width as the at least one spike extends from the lower surface.

7. The tubing tray as set forth in claim 5, wherein the plurality of spikes are configured into at least one L-shaped configuration disposed near a corner of the lower surface.

8. The tubing tray as set forth in claim 5, wherein the plurality of spikes are configured into an X-shaped configuration disposed near a center of the lower surface.

9. A method for collecting fluids draining from drill pipe tripped out of a drill string on a drilling rig, the method comprising the steps of:

a) providing a tubing tray for use with a pipe mat for receiving, organizing and storing drill pipe tripped out of a drill string on a drilling rig, the tubing tray comprising:

i) a substantially planar bottom member further comprising an upper surface, a lower surface and a perimeter edge extending around a perimeter of the bottom member, ii) a sidewall extending upwardly from the perimeter edge along the perimeter, the sidewall substantially orthogonal to the bottom member thereby defining a basin therein, the basin configured to receive a pipe mat placed therein, the sidewall further comprising an upper edge thereon, iii) a chamfered sidewall extending upwardly and outwardly from the upper edge of the sidewall to define a seam therebetween, the chamfered sidewall extending along the seam, the chamfered sidewall further comprising a top edge thereon, wherein the combination of the sidewall and the chamfered sidewall are configured to provide clearance for a tool joint disposed on an end of the drill pipe placed on the pipe mat, and iv) a handle extending along the top edge of the chamfered sidewall, the handle further comprising a downwardly extending lip disposed therealong thereby forming a finger hold disposed thereunder;

b) placing the pipe mat into the tubing tray; and c) placing an end of a drill pipe tripped out of the drill string onto a pipe nub disposed on the pipe mat, wherein fluids disposed within the drill pipe can drain from the drill pipe through openings extending through the pipe mat and collect in the tubing tray.

10. The method as set forth in claim 9, wherein the bottom member comprises a rectangular shape.

11. The method as set forth in claim 9, wherein the tubing tray further comprises a slot extending through the lip, the slot configured to receive a fastener passed therethrough, the fastener configured to pass through the slot of a second tubing tray wherein the tubing tray and the second tubing tray can be fastened together with the fastener.

12. The method as set forth in claim 11, wherein the tubing tray further comprises a second slot extending through the lip on an opposing side of the tubing tray wherein a plurality of tubing trays can be fastened together in a side by side configuration.

13. The method as set forth in claim 9, wherein the tubing tray further comprises a plurality of spikes disposed on the lower surface of the bottom member extending downwardly therefrom.

14. The method as set forth in claim 13, wherein at least one spike comprises a rectangular shape or a trapezoidal cross-sectional shape that tapers or narrows in width as the at least one spike extends from the lower surface.

15. The method as set forth in claim 13, wherein the plurality of spikes are configured into at least one L-shaped configuration disposed near a corner of the lower surface.

16. The method as set forth in claim 13, wherein the plurality of spikes are configured into an X-shaped configuration disposed near a center of the lower surface.

* * * * *